US006212931B1

(12) United States Patent
Solfronk

(10) Patent No.: US 6,212,931 B1
(45) Date of Patent: Apr. 10, 2001

(54) RIVET SETTING TOOL WITH ROTATION REVERSAL DEVICE

(75) Inventor: Antonin Solfronk, Albrechtice Nad Vlatavou (CZ)

(73) Assignee: MS Verwaltungs- und Patentges. mbH (DE)

( * ) Notice: Subject to any disclaimer, the term of this patent is extended or adjusted under 35 U.S.C. 154(b) by 0 days.

(21) Appl. No.: 09/479,461

(22) Filed: Jan. 6, 2000

(30) Foreign Application Priority Data

Jun. 1, 1999 (DE) ..... 299 00 048 U

(51) Int. Cl.[7] ..... B21D 9/05; B21J 15/22

(52) U.S. Cl. ..... 72/391.8; 72/114; 29/243.525; 29/243.526

(58) Field of Search ..... 29/243.526, 243.523, 29/243.525; 72/391.8, 114

(56) References Cited

U.S. PATENT DOCUMENTS 4,612,793 * 9/1986 Klein ..... 72/114
4,821,555 * 4/1989 Kamata et al. ..... 72/391
5,490,311 * 2/1996 Rosier ..... 29/243.526

* cited by examiner

*Primary Examiner*—David Jones

(57) ABSTRACT

A rivet setting tool for setting blind rivet nuts has a rotation reversal device including a valve slide and a slide housing that is moveable into a forward position and a rear position, a rotary motor connected to a feed spindle and having a direction of rotation that is controllable by the rotation reversal device, a pressure medium piston/cylinder device that is operable for a rivet upsetting process and confers an axial motion on a threaded bolt via the feed spindle, and a device that actuates the pressure medium piston/cylinder device and the rotation reversal device. The rotation reversal device includes a fixing device that at least temporarily fixes the position between the valve slide and the slide housing, the fixing device engaging with the valve slide.

17 Claims, 3 Drawing Sheets

RIVET SETTING TOOL WITH ROTATION REVERSAL DEVICE

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates to a rivet setting tool for setting blind rivet nuts, and a rotation reversal device.

2. Discussion of Relevant Art

Riveting tools for setting blind rivet nuts are known, which have a pressure medium rotary motor which, for first screwing a threaded rivet nut onto a threaded bolt of the apparatus, displaces the said bolt in right-hand rotation; and a separately operable pressure medium driven thrust device, which then in the course of the riveting process proper confers on the said bolt an axial motion for the upsetting process of the threaded rivet nut. After the end of the upsetting process, the pressure medium rotary motor is then driven so that the threaded bolt is displaced in left-hand rotation for unscrewing of the threaded nut. Such a blind rivet setting device can be gathered, for example, from German Patent DE-OS 37 01 883.

It is known from workshop practice that problems often arise in this and similar equipment in the transition from right-hand to left-hand rotation, the function of which is based on a complicated interplay between the pressure medium piston/cylinder drive, a rotation reversal device which is associated with the rotary motor, and a valve device which controls via an operating press button the supply of pressure medium to both the rotation reversal device and also the pressure medium piston/cylinder. Functional failures then appear particularly in that left-hand rotation is no longer possible, or on the contrary the pressure medium rotary motor can now be driven only in left-hand rotation.

SUMMARY OF THE INVENTION

The invention therefore has as its object to provide a rivet setting tool which avoids the above mentioned functional disadvantages of the prior art.

This object is attained by a rivet setting tool for setting blind rivet nuts, comprising a rotation reversal device including a valve slide and a slide housing that is moveable into a forward position and a rear position, a rotary motor connected to a feed spondle and having a direction of rotation that is controllable by said rotation reversal device, a pressure medium piston/cylinder device that is operable for a rivet upsetting process and confers an axial motion on a threaded bolt via said feed spindle, and a device that actuates said pressure medium piston/cylinder device and said rotation reversal device. Said rotation reversal device includes a fixing device that at least temporarily fixes the position between said valve slide and said slide housing, said fixing device engaging with said valve slide.

This object also is attained by a rotation reversal device for a rivet setting tool that sets blind rivet nuts, having: a slide housing that receives a valve slide in a central bore, said valve slide being movably arranged in said central bore, at least one annular seal forming at least one control space, and at least one coil spring that actuates said valve slide, said rotation reversal device having a fixing device that engages with said valve slide to at least temporarily fix the position between said valve slide and said slide housing.

In that a rivet setting tool for setting blind rivet nuts is provided, which has a rotation reversal device which includes a valve slide and a slide housing and which is movable into a forward and a rear position, and which is equipped with a rotary motor which is connected to a feed spindle and can be controlled by the rotation reversal device, and which has a pressure medium piston/cylinder drive, which is for the upsetting process and which confers an axial motion on a threaded bolt via the feed spindle, and which furthermore has available an actuating device by means of which both the pressure medium piston/cylinder drive and the rotation reversal device are operable, wherein the slide housing has a fixing device which engages in the valve slide such that the position between the valve slide and slide housing is held fast: the transition between the screwing on and screwing off is insured in an advantageous manner, before and after the upsetting process of the blind rivet nut to be set.

It has been found in practice to be advantageous to preferably use a latch device for the fixing device according to the invention, which engages in the valve slide in a mechanically simple manner by means of a suitable latch element, in order thus to establish the position between slide housing and valve slide.

The valve slide is arranged, displaceable longitudinally, within the rotation reversal device with radial play in a central bore of the slide housing. So that the latch device can engage on the valve slide, a preferably radially directed bore is formed in the slide housing to receive the latch device.

The latch device advantageously has a latch ball and/or a latch bolt, for latching in a latching position, arranged in the receiving bore of the latch device. If the latch ball engages in the latching position on the valve slide, a sliding transition between latching and unlatching of the fixing device or latching device is insured in a positive form in this manner.

For establishing a latching threshold, that is, a force threshold which has to be overcome to axially release the valve slide from the slide housing, the latching device furthermore includes, in a positive configuration, at least one spring which is resiliently mounted under the action of pressure against the latch ball and/or the latch bolt and presses this into a latching position.

In an advantageous development of the fixing device according to the invention, there is associated with this an adjusting screw by means of which the spring stress on the latch bolt and/or the latch ball can be adjusted. The reciprocal braking action of the fixing device of the valve slide housing on the valve slide can thereby be controlled in a simple manner.

It is furthermore advantageous that the latching device or the adjusting screw, the latch ball and/or the latch bolt, have openings and/or are surrounded by an annular space. So that pressure medium, for example compressed air, can also be supplied to the rear control chamber via the latching device.

In a further embodiment of the object of the invention, the receiving bore of the latching device preferably engages in a rear control chamber which is arranged within the central bore, and which is constituted by an annular seal engaging around the valve slide and dividing the free space present between the central bore and the valve slide into a forward and a rear control chamber.

In a continuing positive embodiment of the fixing device according to the invention, this includes engagement positions or latching positions, preferably fitted on the head of the valve slide and potentially constituted in the form of a recess; in a particularly preferred embodiment, the compressed air control openings formed in the head portion of the valve slide are used as engagement positions, and advantageously the supply of pressure medium remains insured by means of the engagement of, for example, a latch ball.

In an advantageous embodiment of the object of the invention, the pressure medium piston/cylinder device, the rotary motor, and the rotation reversal device are connected together in an integrated form. The rotary motor and the rotation reversal device are then mounted in an axially displaceable manner in the head of the rivet setting tool, so that the rotation reversal device or the slide housing can be displaced into the rear position, for example in the course of the upsetting process. The rear position means here that the rotation reversal device, or the slide housing and/or the valve slide, is displaced against the feed spindle receiver. In a particularly positive form, in the scope of the rotation reversal device, the valve slide and slide housing are arranged to be movable relative to each other, whereby the very advantageous effect is obtained that, in a withdrawal basically in common with the rotation reversal device, the valve slide can be displaced by coming together with an abutment with respect to the slide housing, and in connection with this relative movement the fixing device can latch in, in order to establish the position (the relationship) between the slide housing and the valve slide in the course of an operation process of the rivet setting tool.

Most advantageously, the forward control chamber is kept open in the position fixed by the fixing device between the valve slide and the slide housing. So that pressure medium access to the rotary motor is controlled for left-hand running for a given time by means of a rotary motor, even when the rotation reversal device has again been moved into the forward position after the end of the upsetting process, due to the abating press pressure, and the valve slide is moved away from its abutment.

In a further positive configuration of the object of the invention, the rivet setting tool includes at least one forward and one rear pressure medium supply duct for the supply of pressure medium to the rotation reversal device, such that, in the state of engagement of the fixing device in the valve slide under pressure medium action of the rear pressure medium supply duct, the engagement of the slide housing in the valve slide is releasable, and the valve slide is displaced substantially to abut against the abutment. As a consequence of the releasing of the fixing device, the valve slide is displaced in an advantageous manner into a rearward position relative to the slide housing, and in parallel with the closing of the forward control chamber, opens the rear control chamber, releasing an access to the rotary motor, and the supply of pressure medium sets this rotary motor in a right-hand rotation.

BRIEF DESCRIPTION OF THE DRAWINGS

The invention will now be described with reference to the accompanying drawings, in which.

DETAILED DESCRIPTION OF PREFERRED EMBODIMENTS

Figure 1:
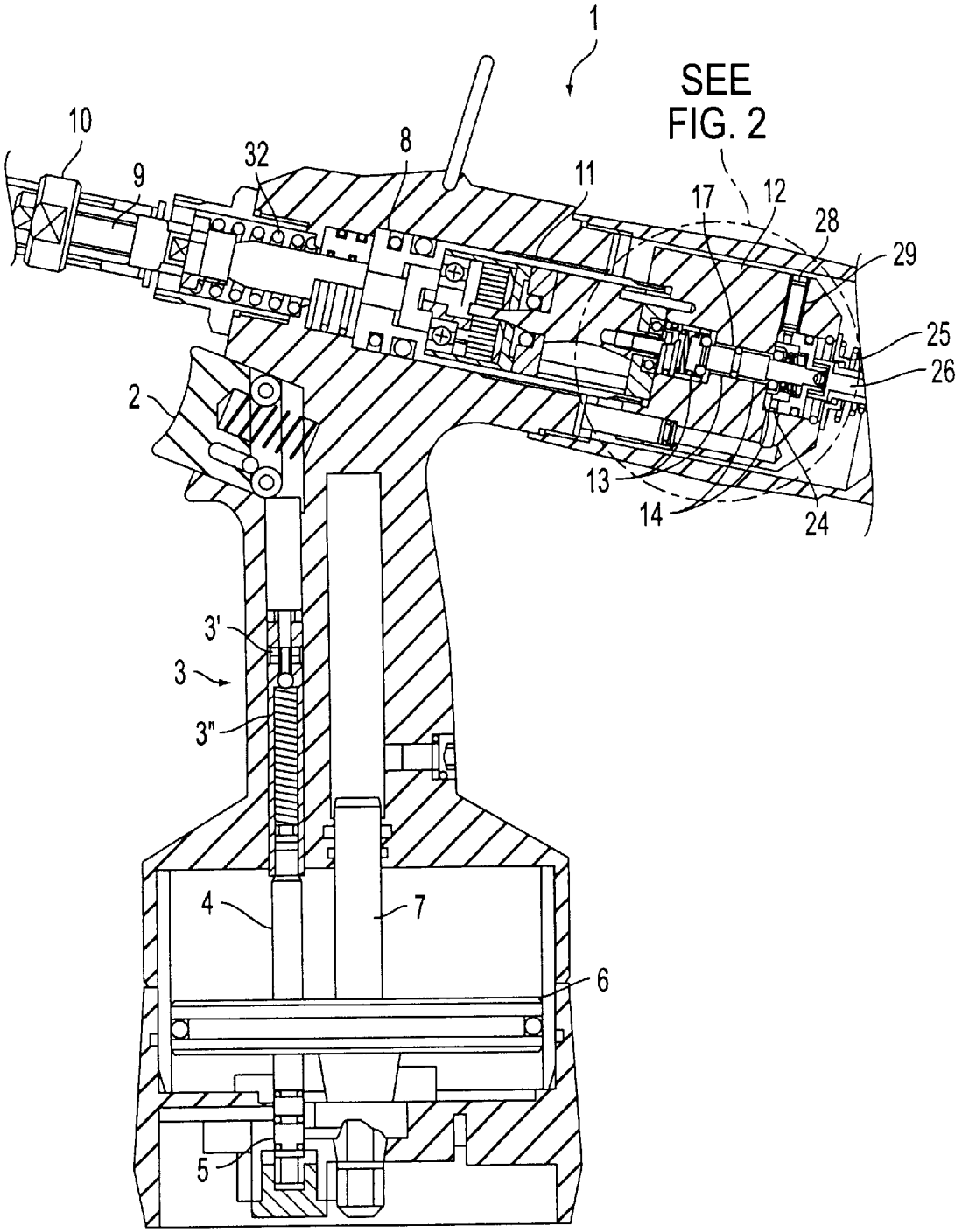
FIG. 1 shows a cross section of the rivet setting tool according to the invention, about in the plane of the longitudinal axis of the rotation reversal device.

The riveting tool 1 as a whole can be seen from FIG. 1. It has, as important components, in the handle and foot region, an actuating press button 2, a pneumatic valve 3, a valve rod 4 and a connection valve 5. The pneumatic valve 3 includes, in the present embodiment, a total of two openings (3', 3"), by means of which the compressed air connections can be made to the rotation reversal device 12. Here the lower pneumatic valve opening 3" forms a compressed air connection with the forward control chamber 13 within the rotation reversal device 12 and the upper pneumatic valve opening 3 a pneumatic connection to the rearward control chamber 14 of the rotation reversal device 12. The compressed air supply, generally supplied by an external compressor, for example, is controlled by means of the connection valve 5. In the unpressed or only lightly pressed state of the actuating press button 2, the connection valve is opened for compressed air, so that the pneumatic valve is supplied with compressed air, which in turn can be supplied to the rotation reversal device by means of the openings 3' and 3", the upper pneumatic valve opening being opened only by the lightly pressed actuating press button; the lower pneumatic valve opening, however, is open in both the unpressed and the lightly pressed state, so that the forward control chamber 13 is under air pressure in both the said positions of the pneumatic valve 3.

Furthermore, the pneumatic piston 6 and the press piston 7 are installed in the foot and handle region. A substantially incompressible hydraulic fluid, preferably oil, is forced by the press piston 7 during the course of the upsetting process or feed process via a hydraulic duct into the cylinder of the working piston 8. The working piston has a connection to the tie bolt receiver 10 via the feed spindle 9 in the rivet setting tool head, and is furthermore, with respect to the rear portion of the rivet setting tool 1, combined in an integrated form with the rotation reversal device 12 via the rotary motor 11, so that in this manner, during the feed phase or the upsetting phase, the rotation reversal device which is longitudinally displaceably arranged in the head portion of the rivet setting tool 1, and the likewise movably arranged rotary motor 11, can be displaced into different axial positions within the rivet setting tool head 1, substantially depending, in the course of controlling the transition between the left-hand running and right-hand running of the rotary motor, on the position of the rotation reversal device before and after completion of the upsetting process.

Figure 2:
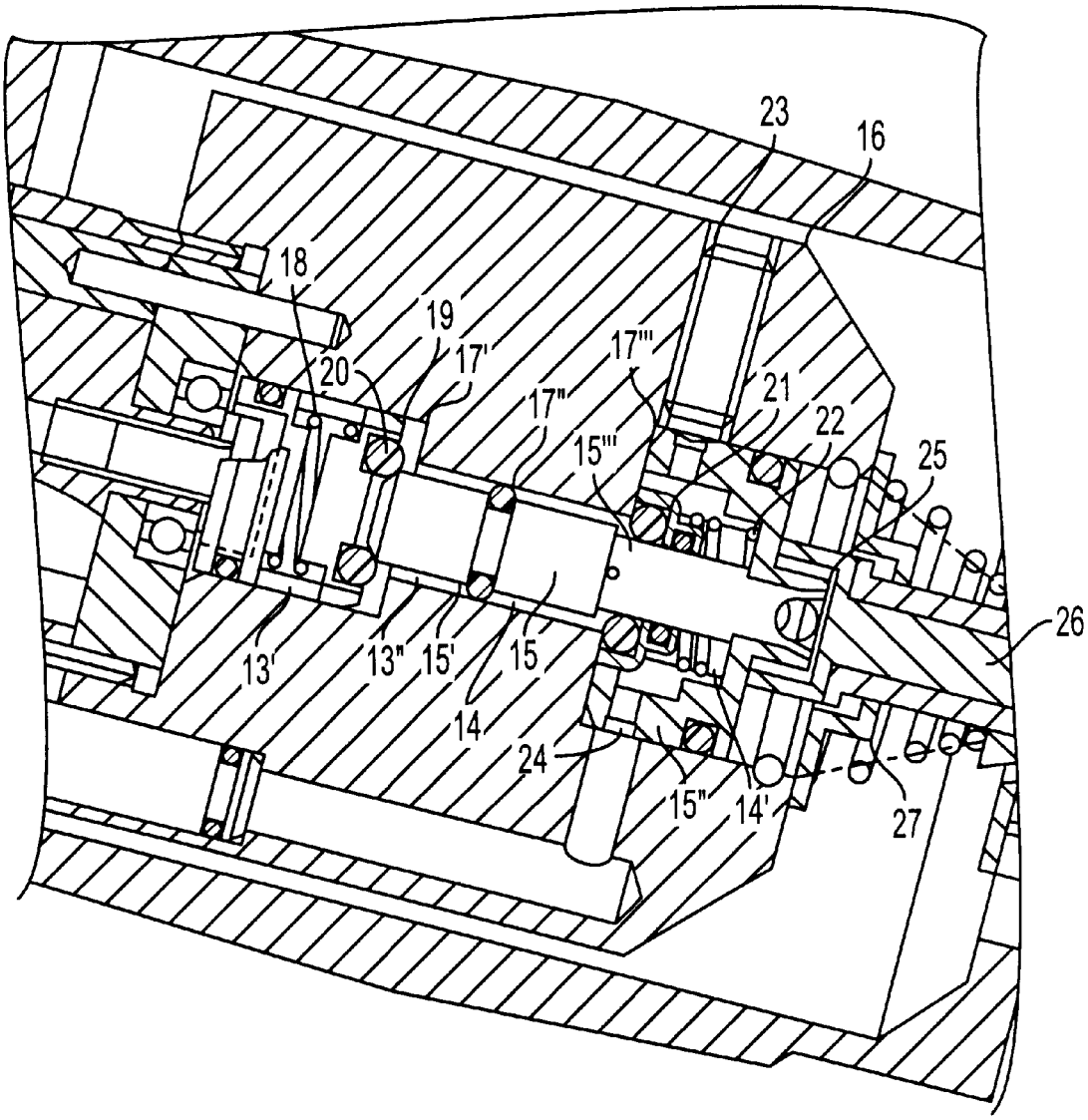
FIG. 2 shows a cross section of the rotation reversal device according to the invention in detail in the latched state of the latching device.
Figure 3:
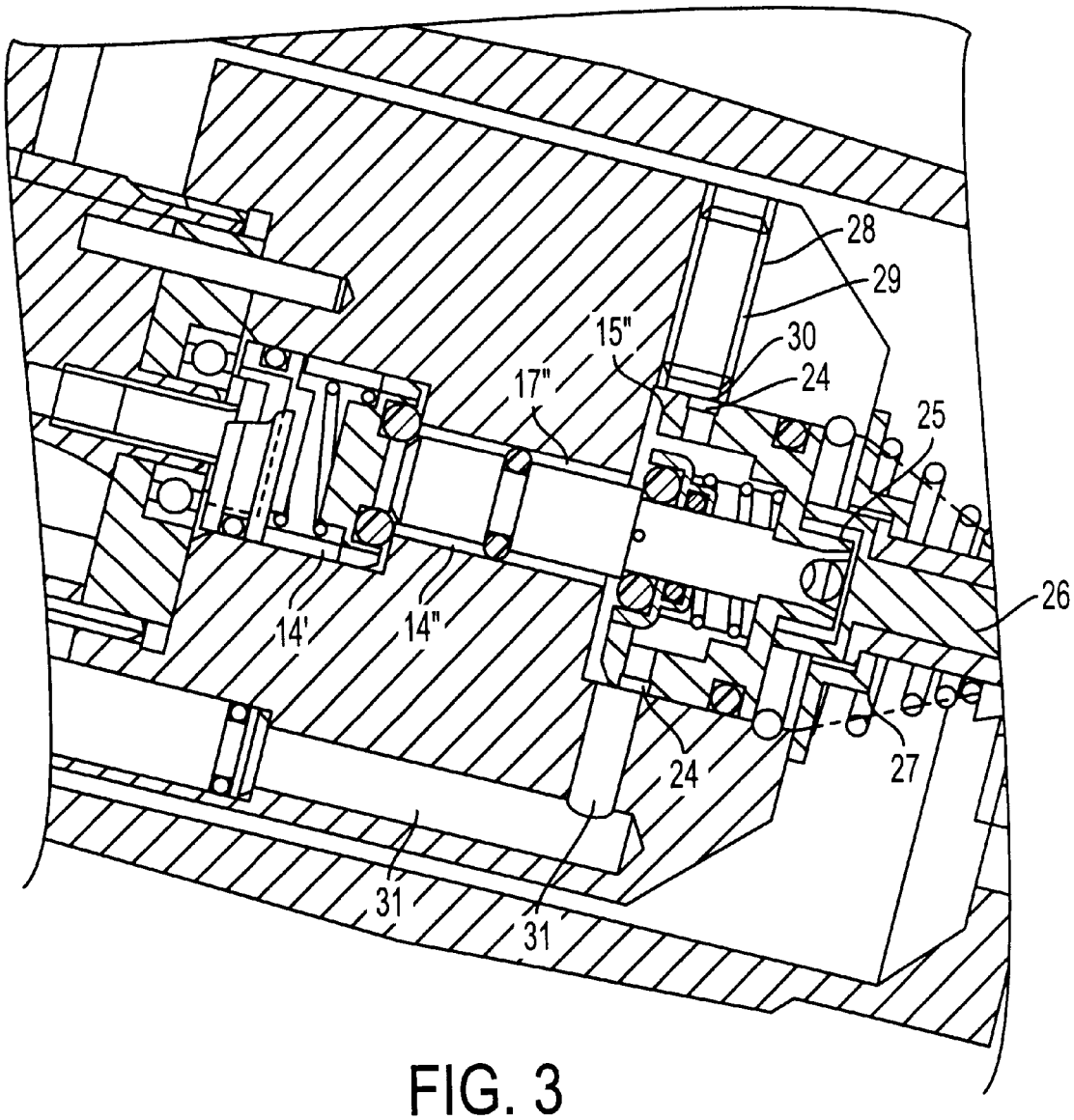
FIG. 3 shows a cross section of the rotation reversal device according to the invention in detail in the non-latched state of the latching device.

A detail of the rotation reversal device 12 according to the invention can be seen in FIG. 2. According to FIGS. 2 and 3, the rotation reversal device 12 consists of a valve slide 15 and a slide housing 16, with the slide housing 16 including a central bore 17 to receive the valve slide 15. The central bore has three regions 17', 17" and 17'", which differ in their cross sections. The region of smallest diameter, which is situated between the regions 17' and 17'", serves substantially as a shaft guide for the valve slide 15. A rear coil spring 18 is arranged in the forward region 17' of the central bore 17. The coil spring foot, constructed in the form of a plate, is fastened by a screw connection to the forward most end of the central bore 17; the coil spring foot has a groove laterally toward the wall of the central bore 17, with an annular seal running in it and forwardly sealing the central bore 17. The coil spring furthermore includes a spring plate 19 in the region of its end with respect to the smaller diameter region 17"; a circular sealing groove was installed on the head side surface of the said spring plate 19, such that after the insertion of a suitable annular seal or forward control seal 20, this in the extended state of the coil spring abuts against the transition edge between the regions 17' and 17", and closes off the space which is formed by the spring plate 19 and the spring foot, and which furthermore is also to be designated as the pressure medium supply region of the forward control chamber 13, substantially airtightly with respect to the remaining space 17" and 17'" between the central bore 17 and the valve slide 15. This closing off is in particular to be encountered when the threaded bolt is situated in the inoperative position.

In the said inoperative position, the valve slide 15 is situated within the residual region of the central bore 17, i.e., substantially above the pressure medium supply region of the forward control chamber 13. It consists here of a shaft portion 15' and a head portion surrounding the valve slide head 15" and the valve slide extension 15'". The shaft 15' of the valve slide 15 is situated, or runs, substantially within the middle region 17" of the central bore 17. A sealing recess is situated substantially in the middle of the shaft 15', and an annular seal runs in it and is situated in a sliding seating on the central bore wall, and divides the free space situated between the central bore 17 and the valve slide 15 into a forward control chamber 13 and a rear control chamber 14. The valve slide 15 or valve slide shaft 15', constructed as a hollow cylinder, has its edges slightly beveled at the forward end.

An extension 15'", of smaller diameter relative to the shaft portion 15' of the valve slide, extends into the head region 15" and 15'" of the valve slide 15. A closure 15", shaped as a sleeve, is installed at the rear end of the hollow cylindrical extension 15'". The sleeve 15" has a three-step profile in its inner region; a rear coil spring 22 is seated on the middle step and engages around the valve slide, which guides it. The coil spring 22 has at its front end a rear spring plate 23 with a middle opening to receive the valve slide 15. The rear spring place 23 furthermore has two sealing grooves to receive sealing rings. The first sealing groove is aligned such that a sliding seal seating arises between the valve slide 15 and the spring plate 23. The second sealing groove is situated at the head side of the spring plate 23. This groove is given an L-shape and hence has on the inner side no guiding wall which bounds the inserted sealing ring 21 with respect to the valve slide 15, so that the second sealing ring 21 is also situated in a sliding seal seating with the valve slide 15. Depending on the position of the valve slide 15 with respect to the slide housing 16, the spring plate 23 or the second sealing ring 21 is seated either on the edge which is formed by the transition from the larger-diameter shaft portion 15' of the valve slide 15 to the smaller-diameter extension 15'" of the valve slide, or is seated on the edge at the transition between the opening regions 17' and 17'" and thus seals the space 17'" from the residual space. As can be seen from FIGS. 2 and 3, the sleeve 15" forms the rear closure and in given positions also the lateral closure of the rear control chamber 14 or of the pressure medium supply region 14' of the rear control chamber 14.

The outside of the sleeve 15" has a substantially two-step profile. A sealing groove has been installed in the sleeve 15" at the end of the height of the first step and laterally with respect to the central bore wall 17, and has a sealing ring inserted into it, so that the sleeve 15" or the head 15 of the valve slide 15 seals against the central bore 17 in a sliding seal seating. Furthermore, several radially directed control bores are installed in the sleeve envelope for the supply of compressed air into the rear control chamber 14. The second step is formed at the rear side of the sleeve 15" in the region of the rear sleeve opening, and engages substantially positively in the mouth opening 25 of an at least partially axially displaceable adjustment device 26, the axial displaceability of the adjustment device 26 and thus also that of the valve slide 15 being limited toward the rear by a stop 27.

The latching device 28 is installed in a radially aligned bore 29 of the slide housing 16 which intersects the rear central bore region 17'" in its forward portion. From inside to outside, it includes substantially three portions arranged one behind the other. These are the latch ball 30, and a latch spring (not shown) and an adjusting screw, by means of which the prestress on the latch ball 30 is adjustable. The radial bore 29 thereby fulfills a double function. Firstly, it serves to receive the latching device 28, and secondly as a compressed air supply to the rear control chamber 14 via, for example, the control bore 24. The air supply can thus be insured by means of grooves or channels in or on the adjusting screw and the latch ball 30. Such a channel is, for example, an annular space which is arranged around the latching device 28 within the bore 29.

By the described double function, it is possible to use a control opening 24 as the latching place, instead of an additional recess. The latch ball 30 then engages only so far into the control opening that a relative movement of the slide housing 16 and the valve slide 15 can be prevented, and that enough play still remains between the latch ball 30 and the opening of the control bore 24, so that a supply is possible of compressed air by means of the receiving bore of the latching device to the control bore 24.

The initial position of the rotation reversal device 12 is shown in FIG. 1. The working piston 8 is situated, together with the rotation reversal device 12, in the forwardmost position when the press button is not actuated. In this initial position, the forward pressure medium supply region 13' is closed from the forward pressure medium discharge region 13' of the forward control chamber 13, so that notwithstanding a supply of compressed air via the opened lower pneumatic valve 3", no compressed air connection takes place by means of the pressure medium discharge region to the rotary motor by means of a compressed air channel (not shown) which controls left-hand running of the rotary motor.

In contrast to this, the rear control chamber 14 is opened. That is, the valve slide 15 within the slide housing 16 is displaced rearward with respect to the slide housing 16. Because of this, the rear control seal 21 is also situated in the rear position, and thus opens a connection between it and the transition edge of the regions 17' and 17'" and thus the rear control chamber 14, so that upon the action of pressure by means of a second compressed air access channel to the rotary motor 11, connecting to the rear compressed air discharge region 14', the said rotary motor can be set in right-hand rotation. Since however the actuating press button 2 is not pressed in the position described above, the upper pneumatic valve opening 3' is closed and thus the pressure supply to the rear control chamber 14 is interrupted. Furthermore, in the rear position of the valve slide or the forward position of the slide housing 16, the control bore 24 of the valve slide head 15" is displaced rearward with respect to the compressed air channel 31, so that the possibility is afforded of a direct compressed air supply to the above-described connection.

If the actuating press button 2 is lightly pressed, the upper pneumatic valve opening 3' likewise opens. Accordingly, as already shown hereinabove, the opened rear control chamber 14 is supplied with compressed air and sets the compressed air motor 11 in right-hand rotation, so that a rivet can be screwed on.

If the rivet is screwed onto the tie bolt, the actuating press button 2 is fully pressed, and actuates the hydraulic valve 5 via the valve rod 4 such that the external compressed air supply to the pneumatic valve 3 is cut off, and the upsetting process is initiated by compressed air supply to the pneumatic piston 6. In the course of the upsetting process, the working piston 8 and thus also the rotation reversal device 12 are displaced from their forward position to their rear position. However, the valve slide 15, which is axially displaceably mounted in the central bore 17 of the slide housing 16, is hindered in its rearward movement by the stop 27, which meets with the adjusting device 26 with which the valve slide 15 is substantially in abutment. This means that the valve slide 15, on the resetting of the rotation reversal device 12 or of the slide housing 16, substantially freezes in its initial position, so that the slide housing 16 can be displaced with respect to the valve slide 15. Because of the displacement of the slide housing 16, the forward control sealing ring 20 is lifted from its original seat and in this manner opens the forward control chamber 13, so that the rotary motor 11 can be displaced in a left-hand rotation upon a potential action of pressure on the forward control chamber 13. Reciprocally, upon resetting, the rear control chamber is closed, in that the central bore regions 17" and 17'" are displaced onto the rear control sealing ring. At the same time, a connection is produced between the control bores 24 and the compressed air supply channels 31 and 29. Because of this connection, the latching device 28 engages in one of the control bores 24 and substantially restricts the axial relative movement between the valve slide and the slide housing.

If the upsetting process has ended, the actuating press button 2 is released and returns into the non-actuated state. Because of this, the compressed air supply to the pneumatic piston 6 is interrupted and that to the pneumatic valve is opened, reciprocally by means of the valve rod 4 and the connection valve 5. This means that, in connection with the previously described position of the valve slide 15 with respect to the slide housing 16, when the press button 2 is not actuated, compressed air is supplied to the rotary motor through the lower pneumatic valve opening 3" by means of the opened forward control chamber 13. The supplied compressed air then leads to left-hand running of the rotary motor and thus unscrewing of the rivet from the tie bolt.

In parallel with the above-described process, the working piston 8 is displaced again into the forward initial position in common with the rotation reversal device 12, due to the hydraulic pressure relief and to the spring tension by means of the spindle spring 32. If for this case the valve slide 15 were not latched to the slide housing 16 by means of the latching device 28, the valve slide 15, (whose tapered front end is seated in a sealing seating with the valve slide 15 because of the prestress with the forward coil spring 18 through the relative displacement between the slide housing 16 and valve slide 15), would be lifted out of this seating and likewise the forward control chamber 13 would be closed by the stretching of the coil spring 18, and thus the left-hand rotation would be ended shortly after the upsetting process.

To avoid this effect, as already shown hereinabove the latching device 28 on the slide housing 16 engages in the valve slide 15, and thereby has the effect that the relative movement between the valve slide 15 and slide housing 16 is restricted. Here the force threshold for the unlatching of the latching device from the latching place can be regulated according to the prestress which is exerted by the latch spring on the latch ball and which can be adjusted by the adjusting screw. It is insured in this manner that also after the upsetting process the forward control chamber 13 remains opened and the rotary motor 11 stays in left-hand rotation, even when the rotation reversal device 12 as a whole, i.e., with the slide housing 16 and the valve slide 15, moves forward, away from the stop 27.

In order to reach the initial position of FIG. 2 again, i.e., back into the position in which the rotary motor 11 is at rest and the valve slide 15 abuts on the stop 27, it is necessary to release the latching position between the valve slide 15 and the slide housing 16. This takes place by again lightly operating the operating press button 2, so that a pneumatic connection is also set up to the pressure medium supply region 14' of the rear control chamber 14. Since the forward control chamber 13 and the rear control chamber 14 are opened or closed only alternately, the rear control sealing ring 21 is situated in a sealing seating to the central bore 17. If now the rear pressure medium supply region 14' is supplied with compressed air, this air presses on the inside of the sleeve 15" and thus presses the valve slide 15 rearward over the latching threshold until it comes to abut against the stop 27. This movement is supported by the rear coil spring 22.

I claim:

1. A rivet setting tool for setting blind rivet nuts, comprising:

a rotation reversal device including a valve slide and a slide housing that is moveable into a forward position and a rear position, a rotary motor connected to a feed spindle and having a direction of rotation that is controllable by said rotation reversal device, a pressure medium piston/cylinder device that is operable for a rivet upsetting process and confers an axial motion on a threaded bolt via said feed spindle, and a device that actuates said pressure medium piston/cylinder device and said rotation reversal device, wherein said rotation reversal device includes a fixing device that at least temporarily fixes the position between said valve slide and said slide housing, said fixing device engaging with said valve slide.

2. The rivet setting tool according to claim 1, wherein said fixing device comprises a latching device.

3. The rivet setting tool according to claim 2, wherein said slide housing has a central axial bore that receives said valve slide and connects to a radially directed bore that receives said latching device.

4. The rivet setting tool according to claim 2, wherein said latching device comprises a latch bolt or latch ball.

5. The rivet setting tool according to claim 4, wherein said latching device includes at least one spring for abutment of said latch ball or latch bolt.

6. The rivet setting tool according to claim 4, wherein said latching device includes an adjusting screw for adjustment of prestress of at least one spring on said latch bolt or latch ball.

7. The rivet setting tool according to claim 6, wherein said adjusting screw and said latch ball or latch bolt include pressure medium openings.

8. The rivet setting tool according to claim 6, wherein said fixing device has an annular space for supply of pressure medium.

9. The rivet setting tool according to claim 1, wherein said rotation reversal device has a forward control chamber and a rear control chamber, said fixing device being arranged substantially in a region of said rear control chamber.

10. The rivet setting tool according to claim 1, wherein said fixing device includes an engagement place that comprises a recess on a head of said valve slide.

11. The rivet setting tool according to claim 10, wherein said engagement place comprises at least one control opening on said head of said valve slide.

12. The rivet setting tool according to claim 1, further comprising a head portion in which said pressure medium, said piston/cylinder device, said rotary motor and said rotation reversal device are connected in an integral manner and are axially displaceable with each other.

13. The rivet setting tool according to claim 1, further comprising an abutment device that abuts said valve slide during resetting movement into a rear portion of said rotation reversal device.

14. The rivet setting tool according to claim 1, wherein in a fixing position between said slide housing and said valve slide a forward control chamber opens as a pressure medium passage for left-hand running of said rotary motor and a rear control chamber closes as a pressure medium passage for right-hand running.

15. The rivet setting tool according to claim 1, further comprising at least one forward pressure medium supply chamber and at least one rear pressure medium supply channel that supply pressure medium to said rotation reversal device, such that, when said pressure medium is supplied to said rear pressure medium supply channel, engagement of said fixing device with said valve slide is releasable and said valve slide is substantially displaceable to abut on an abutment.

16. The rivet setting tool according to claim 1, wherein said slide housing in said forward position closes a pressure medium passage for left-hand running of said rotary motor and opens a pressure medium passage for right-hand running.

17. A rotation reversal device for a rivet setting tool that sets blind rivet nuts, comprising:

a slide housing that receives a valve slide in a central bore, said valve slide being movably arranged in said central bore, at least one annular seal forming at least one control space, and at least one coil spring that actuates said valve slide, said rotation reversal device having a fixing device that engages with said valve slide to at least temporarily fix the position between said valve slide and said slide housing.

* * * * *